United States Patent [19]

Aigrefeuille

[11] Patent Number: 4,548,563

[45] Date of Patent: Oct. 22, 1985

[54] MOLD FOR FORMING ORTHOPEDIC SOLES AND PLANTAR MOLDINGS ADAPTED TO THE FEET OF PATIENTS

[75] Inventor: Charles V. Y. Aigrefeuille, Versailles, France

[73] Assignee: Societe Francaise d'Orthopodie, Paris, France

[21] Appl. No.: 647,099

[22] Filed: Sep. 4, 1984

[30] Foreign Application Priority Data

Sep. 5, 1983 [FR] France ..... 83 14163

[51] Int. Cl.[4] ..... B29C 1/00

[52] U.S. Cl. ..... 425/2; 425/383

[58] Field of Search ..... 425/2, 383

[56] References Cited

U.S. PATENT DOCUMENTS

| | | | |
|---|---|---|---|
| 2,082,451 | 6/1937 | Kivlahan et al. | 425/2 |
| 2,154,169 | 4/1939 | Koehler | 425/2 |
| 2,924,849 | 2/1960 | Buchman | 425/2 |
| 3,444,586 | 5/1969 | Dubner | 425/2 X |
| 3,458,898 | 8/1969 | Casparis | 425/2 |
| 4,012,026 | 3/1977 | Chambers | 425/2 X |
| 4,470,782 | 9/1984 | Zimmerman et al. | 425/2 |

*Primary Examiner*—J. Howard Flint, Jr.

*Attorney, Agent, or Firm*—Neuman, Williams, Anderson & Olson

[57] ABSTRACT

A mold is provided for forming orthopedic soles and plantar moldings adapted to the feet of patients, characterized in that it is formed of a tray (1) with an essentially vertical wall (6), whose bottom (7) reproduces the shape and the instep of a shoe, means (2) for fixing relief correcting elements (4, 5) to this bottom for conferring thereon a surface adapted to the plantar arch of the patient, and a flexible and resilient cushion (3) extending over this bottom.

This mold is used for forming orthopedic soles and plantar moldings by using a thermoformable sheet (9) placed in the tray and on which the foot of the patient bears.

3 Claims, 4 Drawing Figures

1
2
3
4
5
6
7
8
9
10

MOLD FOR FORMING ORTHOPEDIC SOLES AND PLANTAR MOLDINGS ADAPTED TO THE FEET OF PATIENTS

The invention relates to a mold for forming orthopedic soles or plantar moldings adapted to the feet of patients.

At the present time, such soles or moldings are made with plaster by means of a process which is long and dirty to carry out and gives uncertain results. Moldings are also known which are formed by placing the foot of the patient on a cellular foam cushion with interposition either of a sheet of thermoformable material or of a wax-coated cloth, which then allows a positive plaster to be made.

However, these moldings are almost always defective because the position and shape of the foot of the patient on the cushion are in practice not determined, since they depend to a large extent on the perpendicularity and on the muscular action which the patient himself exerts on his foot, voluntarily or not, at the time of the operation.

Now an orthopedic sole in order to be efficient must conform as faithfully as possible to the actual position of the foot of the patient, once corrected and with the shoe on.

This objective is attained in a simple, rational, efficient and inexpensive way in accordance with the invention by using a mold which is characterized in that it is formed of a tray with an essentially vertical wall, whose bottom reproduces the shape and the instep of a shoe, means for fixing relief correcting elements to this bottom so as to confer thereon a surface adapted to the plantar arch of the patient, and a flexible and resilient cushion extending over this bottom.

It will be readily understood that the specialist who has at his disposal a set of molds in accordance with the invention adapted to the size and to the instep of the shoes of patients may carry out the molding by using either a thermoformable material sheet, or a wax-coated cloth which he places in the mold, after the correcting elements and the flexible cushion, the foot of the patient being then, if the perpendicularity is carefully checked, in the exact position corresponding to the subsequent use of the sole obtained.

Advantageously, the means for fixing the correcting elements are formed by an inner sole bonded to the bottom of the tray and coated with a layer of material providing self fastening in cooperation with a similar layer fixed under each of the correcting elements. With this arrangement, the correcting elements required in each particular case may be chosen and positioned very simply and very rapidly and so the same mold may be used for all the patients taking the same size in shoes who desire the same height of heel, without having to make long and delicate adaptations of the mold.

According to an improvement coming within the scope of the invention, the flexible cushion is thicker over the rear zone of the tray corresponding approximately to the heel and to the instep and thinner over the front zone.

Tests carried out have shown that, with this arrangement, the reduction of thickness of the cushion at the rear, which is greater than at the front, may be corrected when the perpendicularity is suitably provided.

In an advantageous embodiment of the invention, the wall of the tray has a height such that it ensures positioning of the cushion and defines a volume sufficient for receiving the foot of the patient with a certain clearance.

Thus good holding and maintenance in position of the foot and of the thermoplastic material sheet or of the wax-coated cloth is provided without hindering the operations of the specialist who is making the molding.

One embodiment of the invention will now be described by way of non limitative example with reference to the accompanying drawing in which.

Figures 1, 2, 3, 4:
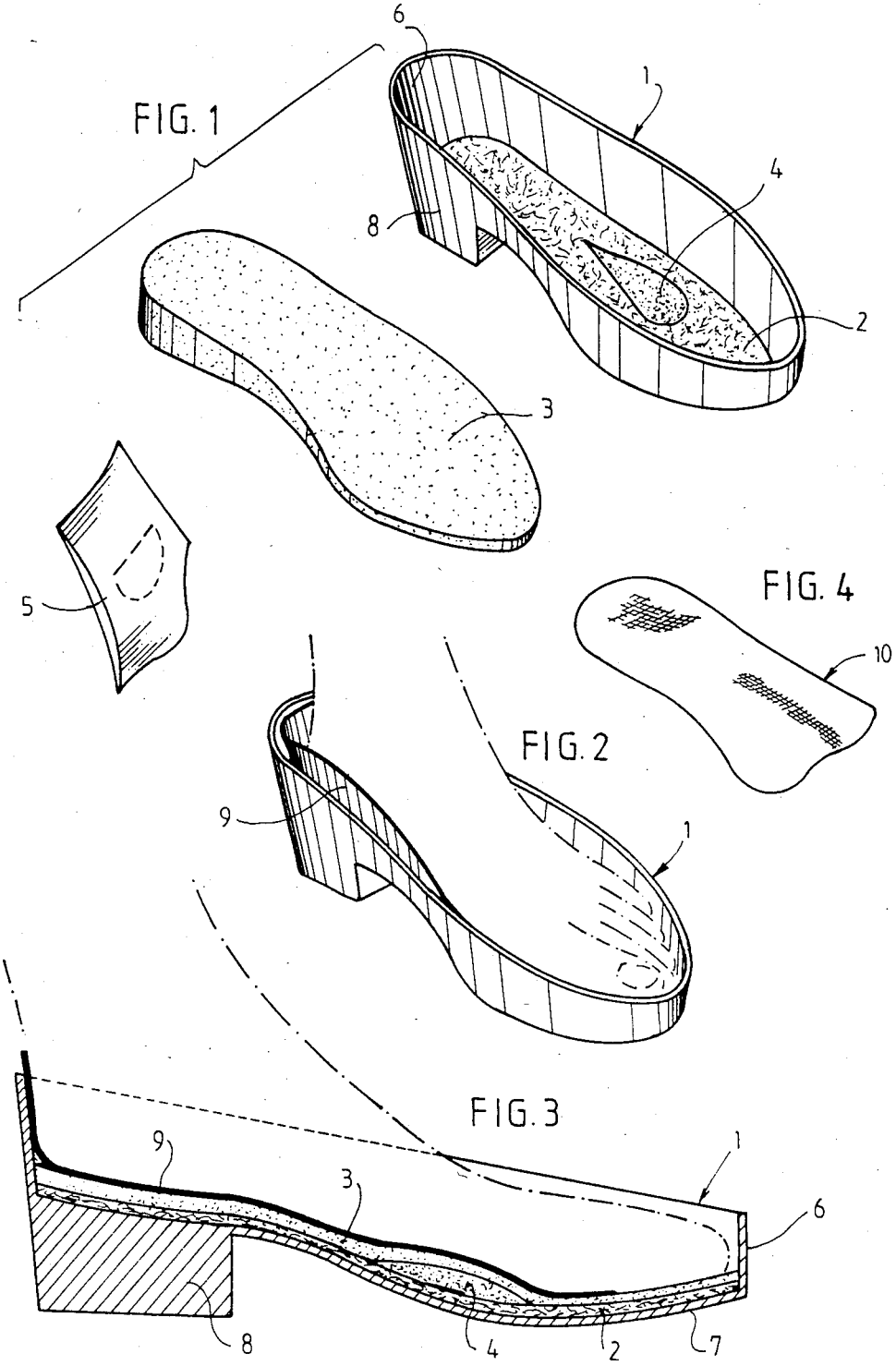
FIG. 1 shows in perspective the different elements constituting the mold of the invention.
FIG. 2 shows the mold during use.
FIG. 3 is a longitudinal section on a larger scale made at the time of molding.
FIG. 4 shows an example of a sole formed by means of the invention.

It can be seen in FIG. 1 that the mold of the invention is formed of a tray 1 to the bottom of which is bonded an inner sole 2, a cushion 3 and a number of correcting elements such as 4 and 5.

The tray 1, made advantageously from a plastic material, comprises an essentially vertical side wall 6 and a bottom 7 reproducing the shape and the instep of a shoe and which, for this, rests on a heel 8. It should be noted that such a tray forms part of an assembly corresponding to the different shoe sizes for men, women and children, and to the different insteps resulting from the heel heights the most often used for example, 3, 5, 7 cm and more if required.

The inner sole 2 which covers the bottom of the tray is preferably bonded. It is provided with a layer of self fastening material, such as the one known under the trade name "velcro", which cooperates with a corresponding layer bonded under the different correcting elements such as 4 and 5.

The correcting elements shown by way of examples are intended to take into account, one 4, a collapse of the front arch of a patient and the other 5 a hollow foot of another patient. They in their turn form part of an assembly which the orthopedist must have at his disposal in order to comply with the most usual characteristics of the feet to be treated, it of course being understood that if required he may form other elements on request.

Finally, the cushion 3 may be made from a cellular foam. It is thicker over about the rear two thirds so as to take into account the weight of the body of the patient.

Such equipment is used in the following way: the orthopedist who desires to form a molding chooses first of all the mold adapted to the shoe size, the instep and the heel height of the shoes which the patient desires to wear. Through successive tests, he then places, if required the correcting elements which best compensate for certain particularities of the anatomy of the plantar arch of the patient.

To carry out the molding properly speaking, he places in the mold the cushion 3 and a commerciably thermoformable sheet used at less than 100° C., such as the one shown at 9 in FIG. 2, which has been suitably cut out and heated, and finally he causes the patient to place his foot in the tray while bearing his weight on it and carefully checks that the position approximates as much as possible to the normal anatomical axes. This is the position shown in FIG. 2. Through the weight of the body and the flexibility of the cushion 3, the thermoformable material is then molded, as can be best seen in the sectional view of FIG. 3, to the exact shape of the foot and of the shoe which the patient will use.

All that is then required is to remove the thermoformed sheet and to cut it out so as to obtain an orthopedic sole such as the one shown at 10 in FIG. 4, which is of a high precision and as thin as possible.

It goes without saying that if a positive plaster molding is desired, the same equipment may be used for forming a negative, by using for example a wax-coated cloth instead of the thermoformable material.

Furthermore, the process described applies not only to the formation of orthopedic soles for people suffering from the feet, but also to the formation of made to measure removable anatomical insteps for people who, although not suffering, are not at ease in their shoes whose insteps do not always corresponds to the shape of their feet.

Whatever the use desired, it will be noted that an element of small thickness is obtained in a few moments by means of the invention which reproduces as exactly as possible the anatomical instep of the plantar arch treated.

I claim:

1. A mold for forming orthopedic soles and plantar moldings adapted to the feet of patients, formed by a tray (1) whose bottom (7) reproduces the shape and the instep of a shoe, characterized by the presence of means (2) for fixing, to this bottom defined by an essentially vertical wall, relief correcting elements (4, 5) for conferring thereon a surface adapted to the plantar arch of the patient, said means being formed by an inner sole (2) bonded to the bottom of the tray and covered with a layer of material ensuring self fastening in cooperation with a similar layer fixed under each of the correcting elements (4, 5), and a flexible and resilient cushion (3) extending over this bottom.

2. The mold according to claim 1, characterized in that the flexible cushion (3) is thicker over the rear zone of the tray corresponding approximately to the heel (8) and to the instep and thinner over the front zone.

3. The mold according to claim 1, characterized in that the wall (6) of the tray (1) has a height such that it ensures positioning of the cushion (3) and defines a volume sufficient for receiving the foot of the patient with a certain clearance.

* * * * *